United States Patent [19]

Morrison, Jr.

[11] Patent Number: 4,645,425

[45] Date of Patent: Feb. 24, 1987

[54] TURBINE OR COMPRESSOR BLADE MOUNTING

[75] Inventor: Robert L. Morrison, Jr., East Hartford, Conn.

[73] Assignee: United Technologies Corporation, Hartford, Conn.

[21] Appl. No.: 683,826

[22] Filed: Dec. 19, 1984

[51] Int. Cl.[4] ..... F01D 5/30

[52] U.S. Cl. ..... 416/215; 416/219 R

[58] Field of Search ..... 416/216, 215, 218, 219 R, 416/220 R, 248, 244 A, 500, 217

[56] References Cited

U.S. PATENT DOCUMENTS

| | | | |
|---|---|---|---|
| 2,211,866 | 8/1940 | Soderberg | 416/216 |
| 2,225,769 | 12/1940 | Conrad | 416/216 |
| 2,240,742 | 5/1941 | Allen | 416/216 |
| 2,809,801 | 10/1957 | Curry | 416/216 |
| 3,216,700 | 11/1965 | Bostock, Jr. | 416/216 |
| 3,584,971 | 6/1971 | Ortolano | 416/218 |
| 3,610,778 | 10/1971 | Suter | 416/221 |

FOREIGN PATENT DOCUMENTS

| | | | |
|---|---|---|---|
| 0353750 | 6/1961 | Switzerland | 416/220 R |

*Primary Examiner*—Robert E. Garrett
*Assistant Examiner*—Edward Li
*Attorney, Agent, or Firm*—Norman Friedland

[57] ABSTRACT

In a turbine or compressor blade and supporting disk assembly in which the assembly is by tangential positioning of the blades, the cooperating blade root and groove in the disk have base surfaces that are held in spaced relation to each other by a rib on the blade root extending toward the base surface of the groove and into contact with it.

3 Claims, 2 Drawing Figures

TURBINE OR COMPRESSOR BLADE MOUNTING

DESCRIPTION

1. Technical Field

This invention is concerned with the blade mounting for gas turbine engines in which the blades are inserted tangentially into the supporting disk.

2. Background Art

The root for a compressor or turbine blade is necessarily made smaller in size than the mounting groove in the periphery of the disk in order that the blades may be readily assembled and moved circumferentially around the disk into position. This root and mounting are also provided with clearance therebetween to provide for differential thermal heating of the root and disk during transient conditions of turbine engine operation. These clearances allow a measure of tangential tipping of the blade or the disk particularly during starting when the structures are cold or during windmilling of the rotor.

The blades generally have integral platforms extending in a circumferential direction and these platforms are generally either in contact with, or in closely spaced relation to, adjacent platforms during turbine operation. When the structure is cold the platforms are normally slightly out of contact with one another and under certain conditions the platforms on adjacent blades may "shingle" or overlap one another. If this condition prevails in operation, and the shingling is not corrected as operation of the turbine continues, the blades are necessarily out of the proper radial position with respect to one another and engine performance is seriously affected detrimentally. This shingled condition may even lead to turbine or compressor failure because of the loading on the tipped blades.

3. Disclosure of the Invention

One feature of the present invention is an arrangement of the cooperating blade root and groove in the disk to overcome the shingling or overlapping effect by preventing the blades from tipping in the circumferential direction after they are installed in the supporting disk. Another feature is the use of an extension on the base of the root to contact the base of the groove in the disk and minimize blade tipping about the root as an axis. Another feature is the provision of a circumferentially extending rib located on the base surface of either the root or the disk and extending toward and in contact with the other base surface thereby serving to prevent tipping of the blade structure when assembled in the disk.

According to the invention the blade root has a radial projection thereon extending integrally from the root and into contact with the base surface of the groove in the periphery of the disk. This projection in the form of a narrow rib, is preferably located midway of the base of the root and extending in the direction parallel to the side supporting surfaces of the root that engage with cooperating surfaces on the groove and the disk. This rib extends the entire dimension of the root in this direction which is a circumferential direction when the blade is mounted in the disk. The height of the rib is such as to hold the root against the blade supporting surfaces in the disk without significantly increasing the thermal or other stresses thereon and without significantly affecting the assembly of the row of blades in the disk. The device is usable on either compressor or turbine disks.

Other features and advantages will be apparent from the specification and claims and from the accompanying drawings which illustrate an embodiment of the invention.

BEST MODE FOR CARRYING OUT THE INVENTION

Figure 1:
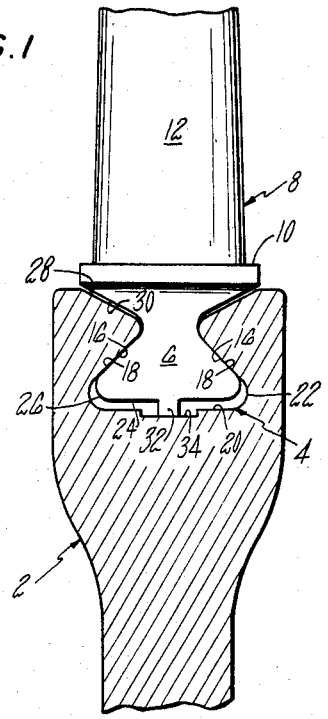
FIG. 1 is a longitudinal sectional view through a fragmentary portion of a disk and a blade mounted thereon.
Figure 2:
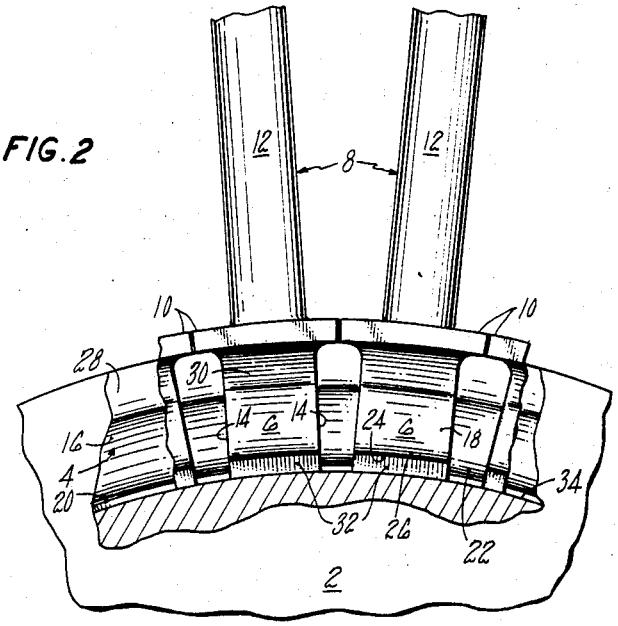
FIG. 2 is a transverse sectional view showing blades located in the periphery of the disk and showing the platforms on the blades.

The invention is shown in conjunction with a compressor disk 2, only a part of which is shown, and having a groove 4 in its periphery to receive the roots 6 of blades 8. Each blade has the root 6, a platform 10 radially outward of the root, and an air-foil portion 12 extending radially outward from the platform and forming a portion of the blade over which the power gas is directed. The several platforms 10 which are shown as closely spaced from one another form the inner wall of the gas path when the row of blades are assembled onto a supporting disk. As shown, the platforms 10 extend in a circumferential direction beyond the end surfaces 14 of the blade roots, thus it is these platforms that establish and maintain the desired circumferential spacing of the blades when they are assembled in the disk. These platforms are in circumferential alignment as shown.

For supporting the blade securely in the disk, the latter has opposed cooperating sloping surfaces 16 positioning at an acute angle to the centerline of the disk and in a position to engage with cooperating surfaces 18 on the blade root. The surfaces 18 are also sloping surfaces. The groove also has a base surface 20 connecting with the surfaces 16 by curved end surfaces 22 and the blade root has a base surface 24 spaced from the base surface 20 and connecting with the supporting surfaces 18 by curved end surfaces 26.

Radially outward from the surfaces 16 the groove 4 has outwardly sloping surfaces 28 in closely spaced relation to the cooperating surfaces 30 on the blade root. Thus the blade root is generally held substantially in position when the engine is not running by the close relationship of these several cooperating sloping surfaces. However, even though the clearance between these several sloping surfaces is small, the blades have sometimes rocked on the disk about an axis generally coincident with the center of the root and under certain conditions the edge of adjacent platforms become overlapped by the edge of one platform moving beneath the edge of the adjacent platform by reason of this rocking motion. Infrequently these platforms lock in this overlapped shingled relationship to the detriment of the turbine operation as above described.

To prevent this occurrence, the base surface 24 of the root has a projecting narrow rib 32 thereon extending radially inward so as to engage with the base surface 20 of the groove in the disk. When the parts are cold as during assembly the rib is of such a height that it has only slight contact with the base surface of the disk so as not to interfers with reasonably easy assembly of the blade into the disk. The rib extends directly radially from the base when assembled in the disk and also extends the entire length of the blade root between the end walls 14 on the root and is rigid in this radial direction. The rib thus extends in a circumferential direction when the blades are assembled in the disk and serves as a support for the entire length of the blade root to prevent rocking movement of individual blades as for example when the engine is rotated slowly under starting conditions or when windmilled by the fan at the front of the engine.

As shown, it may be desirable to have a recess 34 in the surface 20 of the groove in the area engaged by the rib 32. This recess may be wider than the width of the rib as shown to avoid any assembly problems in putting the roots into the disk. This rib is preferably relatively narrow to minimize the area of the rib that would be in contact with the disk thus reducing the friction surface of the area as the blade is moved circumferentially of the disk during assembly. The thinness of the rib in a radial direction also reduces any thermal stresses resulting from differential thermal expansion and further is located at a point where the thermal differentials will be at a minimum. The rib is of such a height or thickness in a radial direction as to hold the base surfaces on the blade and the groove in spaced relation to each other since this is the case when the supporting surfaces are in contact.

Although the invention is shown on a compressor rotor, the concept is equally applicable to a turbine rotor and is particularly usable in a turbine where the temperature differentials in the rim of the disk and the blades are significantly greater than in the compressor.

It should be understood that the invention is not limited to the particular embodiments shown and described herein, but that various changes and modifications may be made without departing from the spirit and scope of this novel concept as defined by the following claims.

I claim:

1. In a turbine or compressor blade and disk assembly, a disk having a circumferential groove in its periphery to receive the roots of the row of blades, said groove having circumferentially extending opposed sloping surfaces therein and a base surface also extending circumferentially, a blade having a root to fit in said groove, said root having opposed sloping surfaces to engage the sloping surfaces on the groove and thus be supported against radial outward movement relative to the disk, said root also having a base surface normally spaced from the base surface of the groove when the cooperating sloping surfaces are in contact, said blade having a platform adjacent to the root and overlying the disk, said platform extending substantially into contact with the platform on the adjacent blade and the platforms extending beyond the end surfaces of the root, and a rigid rib extending integrally from end-to-end of the base surface on the root in a position to and of a dimension to engage the base surface on the groove in a circumferential direction to hold the cooperating sloping surfaces in contact and prevent tipping of the blade in a circumferential direction.

2. A turbine or compressor blade and disk assembly as in claim 1 in which the rib is relatively narrow to minimize the surface area of the rib in contact with the base surface of the groove.

3. A turbine or compressor blade and disk assembly including:

a disk having a circumferential groove in its periphery to receive the roots of the rotor blades, said groove having opposed circumferentially extending sloping surfaces therein and a base surface also extending circumferentially of the disk, a blade having a root to fit in said groove, said root having opposed sloping surfaces to engage the sloping surfaces on the groove and thus be supported against radial outward movement ralative to the disk, and said root also having a base surface normally spaced from the base surface of the disk when the cooperating sloping surfaces are in contact, said blade having a platform adjacent to the root and overlying the disk, said platform extending substantially into contact with the platform on the adjacent blade and the platforms extending beyond the end surfaces of the root, and a circumferentially extending rib on one of the said base surfaces and extending toward the other base surface and into contact therewith, said rib being rigid in a radial direction with regard to the disk thereby to hold the cooperating sloping surfaces in contact and prevent circumferential tipping of the blade with respect to the disk.

* * * * *